US005538146A

United States Patent [19]

Gast

[11] Patent Number: 5,538,146

[45] Date of Patent: Jul. 23, 1996

[54] GARMENT BAG HANGER

[76] Inventor: Arnold E. Gast, 2033 Concourse Dr., St. Louis, Mo. 63146

[21] Appl. No.: 361,119

[22] Filed: Dec. 21, 1994

[51] Int. Cl.[6] ..... A47F 7/00

[52] U.S. Cl. ..... 211/105.1

[58] Field of Search ..... 211/105.1, 94, 211/87, 123, 162, 175

[56] References Cited

U.S. PATENT DOCUMENTS

| | | | |
|---|---|---|---|
| 596,380 | 12/1897 | Pursley | 211/94 |
| 823,588 | 6/1906 | Demartini | 211/94 |
| 869,233 | 10/1907 | Drucker | 211/94 |
| 2,604,997 | 7/1952 | Pearson | 211/94 X |
| 4,427,119 | 1/1984 | Savino | 211/94 |
| 5,337,905 | 8/1994 | Gast | 211/87 |

*Primary Examiner*—Alvin C. Chin-Shue
*Assistant Examiner*—Sarah L. Purol
*Attorney, Agent, or Firm*—Polster, Lieder, Woodruff & Lucchesi

[57] ABSTRACT

An improved extensible and retractable hanger assembly for hanging articles such as a garment bag is disclosed. The hanger assembly may be mounted on a wall adjacent a projecting corner, for example, or on the top or bottom of a shelf. The hanger assembly includes a plate preferably with at least two sets of holes that are adapted to receive a plurality of fasteners therethrough. The hanging articles are hung on a hanger rod with an easy grip knob at one end which also prevents the articles from falling off the rod. The rod also has a boss projecting outwardly from the rod. The rod may be selectively extended from and retracted into a rod channel which is included in a mounting sleeve. A guide channel which is smaller than the rod channel is adapted to slidably receive the boss and prevent the rod from rotating about its longitudinal axis in the rod channel. The guide channel includes a stop which prevents withdrawal of the rod from the mounting sleeve. Flanges extend along edges of the rod channel and have a plurality of openings which correspond to the holes in the plate. The openings of the flanges are aligned with corresponding holes in the plate to receive fasteners therethrough for mounting the mounting sleeve in proximity to the plate and for then securing the hanger assembly to a wall or shelf. If the hanger assembly is connected to a ventilated shelf having a plurality of openings therethrough, a U-shaped fastener is inserted through the openings in the shelf, then into a pair of holes in the plate and then through a pair of openings in the flanges. The U-shaped fastener is further secured by two capped nuts which are attached to each leg of the fastener.

10 Claims, 3 Drawing Sheets

GARMENT BAG HANGER

BACKGROUND OF THE INVENTION

This invention relates generally to a garment and garment bag hangers, and in particular to an extensible and retractable garment bag hanger assembly to be mounted, for example, adjacent a projecting corner of a wall or on the top or bottom of a solid or ventilated shelf.

Presently, hanging rod kits are available for mounting a hanging rod on a wall by boring a hole in the wall to slidably receive the rod which may be selectively extended from and retracted into the bored hole. Other hanging rods are available which are capable of being mounted on a wall without having to bore a hole in the wall for receiving the rod, such as the valet rods that are shown in U.S. Pat. Nos. 1,015,918 and 1,132,190. However, the valet rods shown in these two patents, along with other prior valet rods known in the art, have many exposed components (e.g., a rod) which decreases the overall aesthetic appearance of a room or closet. Also, because these valet rods have many exposed components, they are more difficult to install and manufacture.

My own U.S. Pat. No. 5,337,905 discloses an extensible and retractable hanger assembly which is used in conjunction with modular closet organizers and is incorporated herein by reference. The hanger assembly set forth in my '905 patent is preferably mounted to a vertical wall of a closet organizer formed with a plurality of holes. My prior invention consists of two main parts, namely a hanger rod with a hook at one end that opens upwardly and a mounting sleeve with flanges extending continuously along its edges. The mounting sleeve slidably receives the rod and prohibits rotation of the rod within the sleeve. When the mounting sleeve is secured to a vertical wall, the rod is disposed between the mounting sleeve and the vertical wall. While this design is effective when used in conjunction with a modular closet organizer and in other environments, it cannot be mounted as effectively to a dry wall surface, for example, since the hanger assembly may not provide adequate structural support. Furthermore, my previously disclosed hanger assembly can be mounted in only one position in order to enable the hook to open upwardly for mounting on a dry wall surface or to the top or bottom side of a shelf.

SUMMARY OF THE INVENTION

Accordingly, one object of the present invention is to provide an improved extensible and retractable hanger assembly which provides adequate structural support when mounted to on any wall surface.

Another object of this invention is to provide a hanger assembly which can easily be installed on the top or bottom of any solid or ventilated shelf or on any wall.

Still another object of this invention is to provide a rod for use in the hanger assembly which is formed at one end to keep articles hung on the rod from falling off the rod, regardless of the position in which the hanger assembly is installed.

A still further object of this invention is to form one end with an easy-to-grip knob that is universally adaptable regardless of position of the hanger assembly.

Further objects of the invention are to provide a hanger assembly which is relatively inexpensive to manufacture, easy to assemble and use, as well as aesthetically pleasing.

These and other objects will become apparent to those skilled in the art in light of the following disclosure and accompanying drawings.

In accordance with the teachings of the present invention, an improved extensible and retractable hanger assembly is adapted to be mounted on a shelf or adjacent to a projecting corner of a wall for hanging or supporting articles such as a garment bag. The hanger assembly includes a plate having a plurality of holes adapted to receive a plurality of fasteners therethrough. A hanger rod has a longitudinal axis and is formed at one end to keep articles hung on the rod from falling off the rod. A mounting sleeve has a rod channel including a bottom with an open slot opposite the bottom which extends the length of the channel and an open mouth generally at one longitudinal end of the rod channel. The open slot has sufficient width to admit the hanger rod through the open slot and into the rod channel with the formed end of the rod extending outwardly from the open mouth of the rod channel such that the rod may be selectively extended from and retracted into the rod channel through the mouth thereof. Flange means extend laterally outwardly from the longitudinal edge of the open slot in the rod channel for engaging the plate. The flange means to receive fasteners therethrough for mounting the plate in proximity to the flange in order to close the open slot of the mounting sleeve for holding the hanger rod from movement laterally out of the rod channel so that the hanger assembly can be mounted on the wall or shelf for reliable operation.

In accordance with a second aspect of the invention, an improved extensible and retractable hanger assembly for hanging articles such as garment bags is adapted to be mounted on a wall adjacent to a projecting corner or on the top or bottom of a solid or ventilated shelf. The hanger assembly generally comprises a plate having a top side and a bottom side and at least two sets of spaced holes. Adjacent holes in each set preferably have the same predetermined lateral spacing from each other. The sets also are spaced at a predetermined horizontal distance. A plurality of fasteners are adapted to be received in the holes in the plate. The hanger assembly further includes a hanger rod having a longitudinal axis. A universal easy grip knob is affixed at one end of the rod and a boss projects outwardly from the rod at a location longitudinally spaced from the knob. A mounting sleeve has a rod channel including a bottom, an open slot opposite the bottom and extending the length of the channel and an open mouth generally at one longitudinal end of the rod channel. A guide channel is formed in the bottom of the rod channel and is smaller than the rod channel. The rod channel is adapted to slidably receive the rod with the knob disposed outwardly from the mouth of the rod channel such that the rod channel may be selectively extended from and retracted into the rod channel through the mouth thereof. The guide channel is adapted to slidably receive the boss and has a stop formed therein engageable with the boss to prevent withdrawal of the hanger rod from the mounting sleeve through the open mouth thereof. The boss is engageable with the sides of the guide channel for holding the hanger rod from rotation about its longitudinal axis in the rod channel. Flanges extend continuously along the longitudinal edge of the slot in the rod channel the entire length of the rod channel. The flanges are constructed for face to face engagement with the top side of the plate. Each flange has at least two openings therein having a horizontal spacing equal to the horizontal spacing between the sets of holes in the plate. The corresponding openings of the flanges are generally vertically aligned and have a vertical spacing equal to the vertical spacing between adjacent holes in the plate whereby the openings in the flanges are adapted to be aligned with holes in the plate and to receive fasteners therethrough for mounting the mounting sleeve on the top side of the plate. The bottom side of the plates is mounted to the projecting corner of a wall or to the top or bottom side of a shelf by inserting the fasteners into the wall or the shelf.

Another aspect of the present invention is that of a method for assembling an extensible and retractable hanger assembly for hanging articles such as garment bags therefrom comprising the steps of:

(a) inserting into an open rod channel of a mounting sleeve of the hanger assembly a hanger rod of the hanger assembly having a longitudinal axis, a knob affixed at one end thereof and a boss projecting outwardly from the rod at a location longitudinally spaced from the knob;

(b) positioning the mounting sleeve of the hanger assembly against a plate in order to close the open rod channel and hold the rod in the rod channel; and (c) securing the mounting sleeve to the plate and then to a wall or shelf.

Other objects and features will be apparent and in part pointed out hereinafter.

BRIEF DESCRIPTION OF THE DRAWINGS

The objects of the invention are achieved as set forth in the illustrative embodiments shown in the drawings in which.

Corresponding reference characters indicate corresponding parts throughout the several views of the drawings.

DESCRIPTION OF THE PREFERRED EMBODIMENTS

Figure 1:
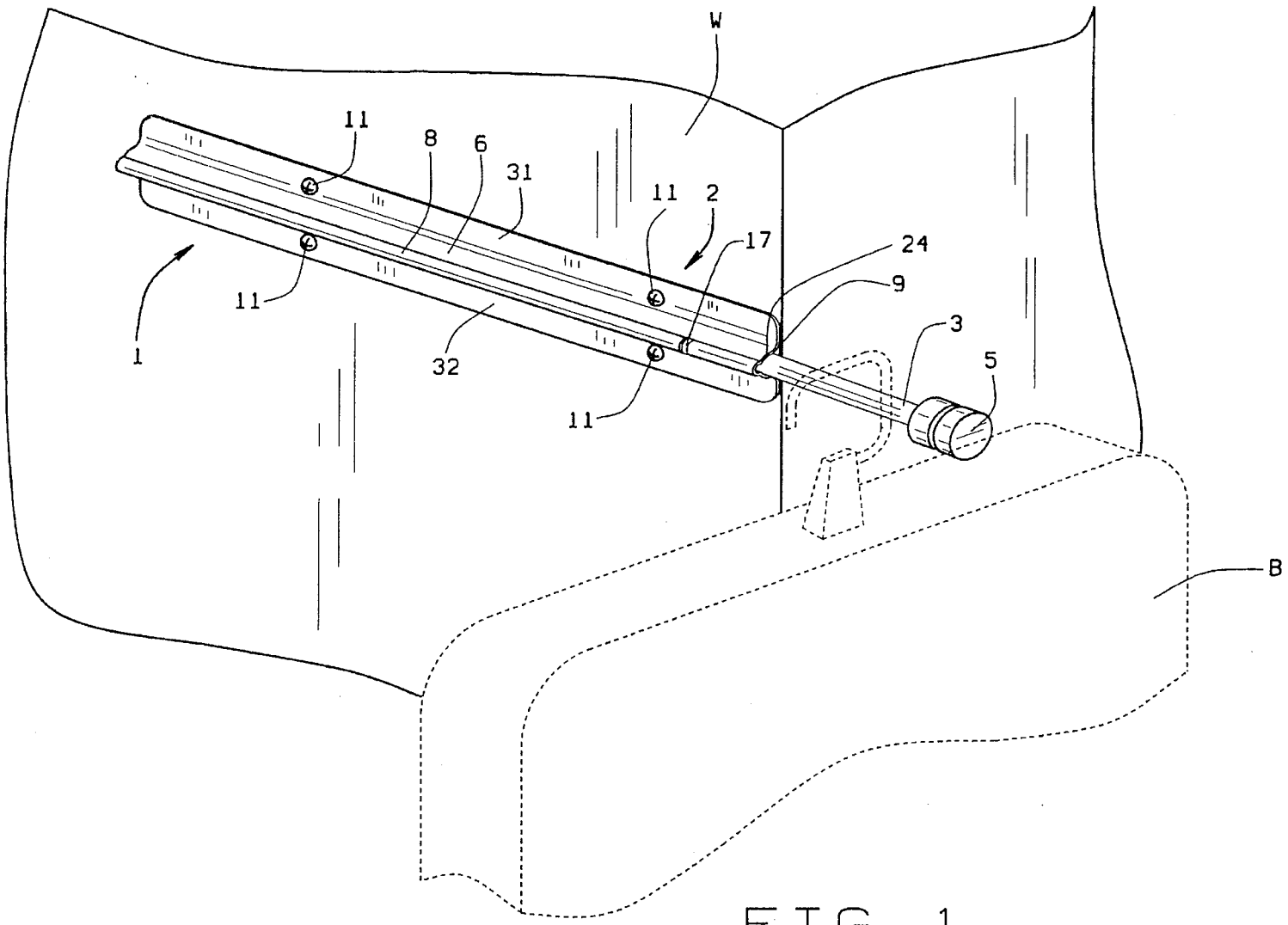
FIG. 1 is a perspective view of a garment bag hanger assembly of the present invention mounted adjacent to a projecting corner of a wall.
Figure 2:
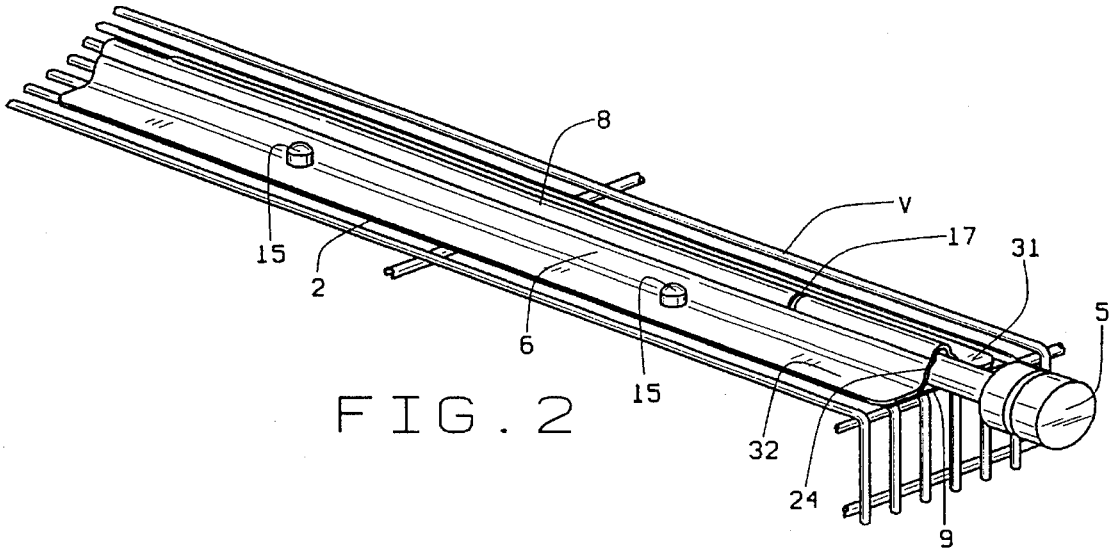
FIG. 2 is a perspective view of the garment bag hanger assembly of the present invention mounted on ventilated shelving.
Figure 3:
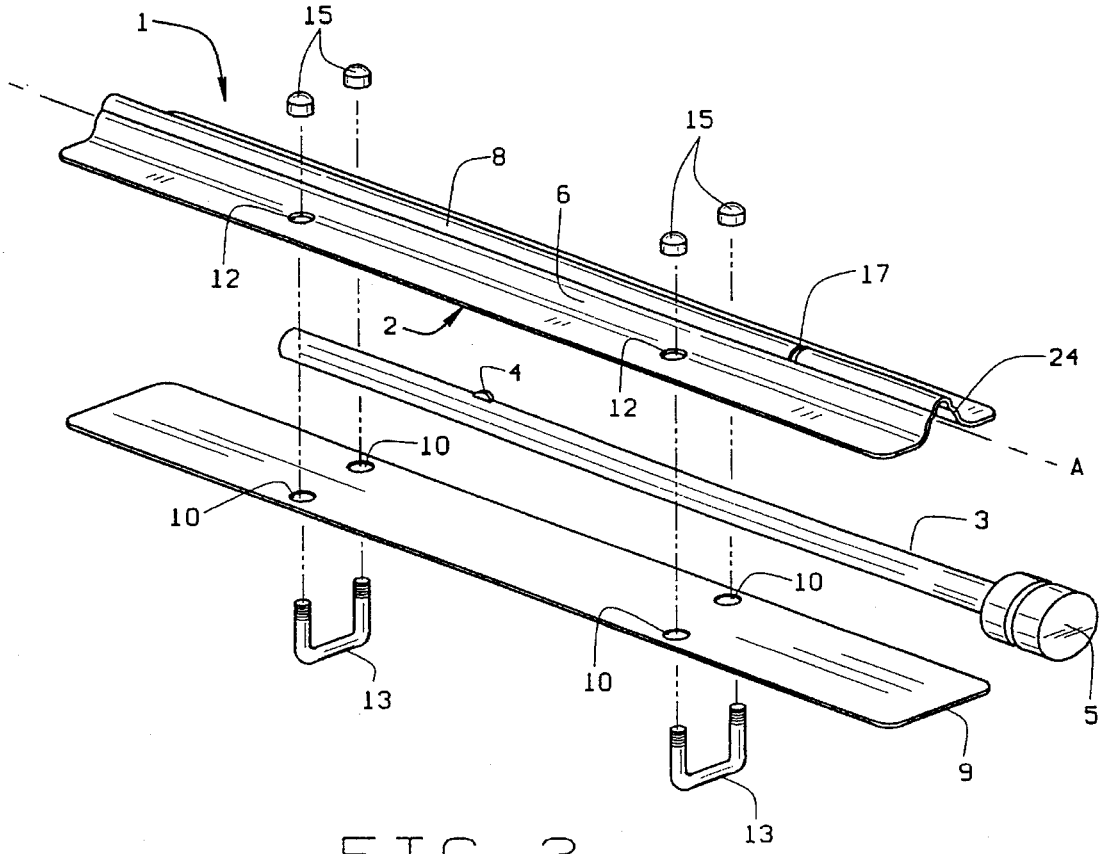
FIG. 3 is an exploded view of the garment bag hanger assembly as employed in FIG. 2.
Figure 4:
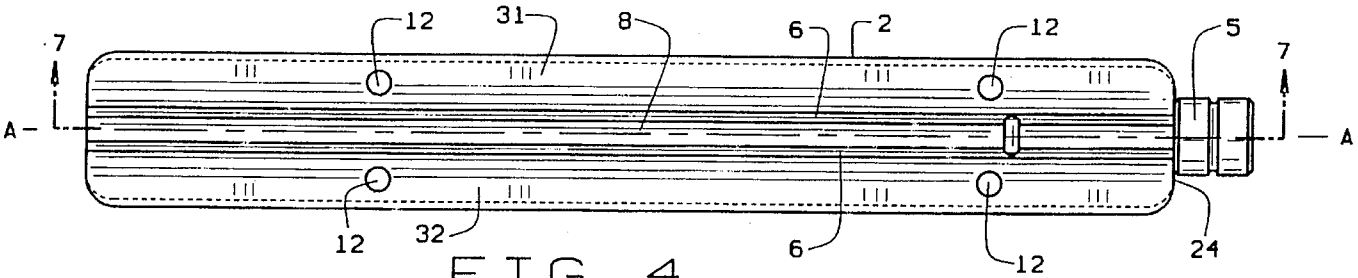
FIG. 4 is a top elevational view of the garment bag hanger assembly.

Referring now to the drawings and particularly to FIG. 1, there is shown an improved extensible and retractable hanger assembly, indicated generally as 1, for hanging or supporting articles, such as a garment bag B. The hanger assembly 1 may also be used for hanging articles of clothing hung on hangers such as suits, shirts or the like. As illustrated in FIG. 1, the hanger assembly may be mounted adjacent to a projecting corner of any existing wall W. In addition, the hanger assembly 1 may be mounted to a top or bottom of a solid shelf (not shown) or a ventilated shelf V, as shown in FIG. 2.

Figure 7:
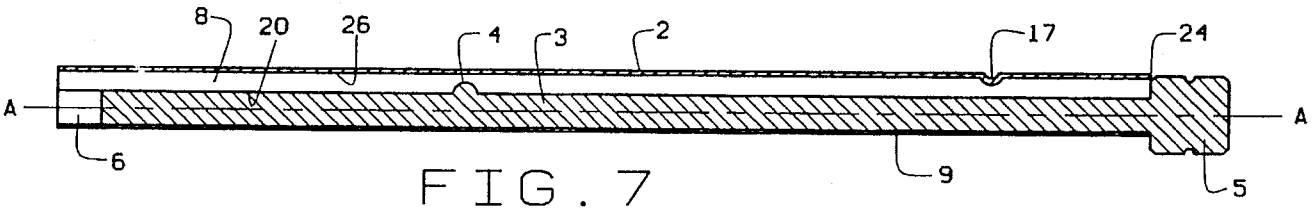
FIG. 7 is a cross-sectional view of the garment bag hanger assembly in a retracted position taken along line 7—7 in FIG. 4.
Figure 8:
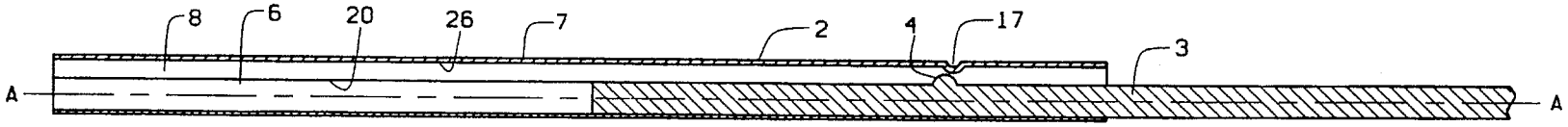
FIG. 8 is a cross-sectional view of the garment bag hanger assembly in an extended position also taken generally along line 7—7 in FIG. 4.

The hanger assembly 1 includes three primary components: a generally rectangularly-shaped plate 9 having a bottom side which is mounted to the wall W (FIG. 1) or a shelf V (FIG. 2) and a top side, a generally rectangularly-shaped mounting sleeve 2 which is mounted on the top side of plate 9 and a hanger rod 3 housed in an area generally defined by mounting sleeve 2 and the top side of plate 9 and slidable between a retracted position (FIG. 7) and an extended position (FIG. 8). The mounting sleeve 2 is preferably made from sheet metal, but could also be formed from other materials such as tough and durable plastic material by an injection molding process. The rod 3 is preferably made from metal stock material.

Turning now to FIGS. 3–6, the sleeve 2 has a rod channel 6 stamped in the sleeve 2 along a longitudinal axis A extending the length of the sleeve 2. The rod channel 6 includes a bottom 20 and an open slot 22 opposite the bottom 20. The open slot 22 extends the length of the rod channel 6 and terminates in an open mouth 24 at one longitudinal end of the rod channel 6. A guide channel 8 is formed at the bottom 20 of the rod channel 6 and is closed at its bottom 26 opposite its opening into the rod channel 6. The guide channel 8 is provided to prevent rotation of the rod 3 relative to the rod channel 6 which will be discussed in greater detail below.

The rod 3, when positioned in the mounting sleeve 2, extends substantially along axis A. Hanging articles are hung from the rod 3. A universally adjustable, easy-to-grip knob 5 is attached to an end of the rod 3 for retaining articles hung on the rod 3 and to prevent them from falling off the rod 3. The easy-to-grip knob 5 also allows a user to easily extend or retract the rod 3 within the sleeve 2. Additionally, the universal shape of the knob 5 allows for effective retention of articles hung on the rod 3 regardless of the orientation of the hanger assembly 1, that is, when mounted to any vertical wall or in a horizontal position on the top or bottom of a shelf.

A boss 4 is provided at the other end of the rod 3 and projects outwardly from the rod 3. The boss 4 is formed by removing a slot of material from the rod which extends longitudinally along axis A and press-fitting a circular slug in the slot. The boss could be formed in other ways such as by welding the boss on the rod. Another possible configuration includes an open slot formed in the rod 3 which extends the length of the rod 3 substantially parallel to axis A and adapted to slidably receive a moveable boss. The moveable boss may be selectively positioned within the open slot to vary the length of the rod which will extend from the open mouth 24 of the mounting sleeve 2. The moveable boss may be held in place within the open slot of the rod 3 by a screw/pin or fastener. Of course, the fixed boss configuration could also be formed at any place along the length of the rod 3 to vary the extension length of the rod, as will be appreciated.

Figure 6:
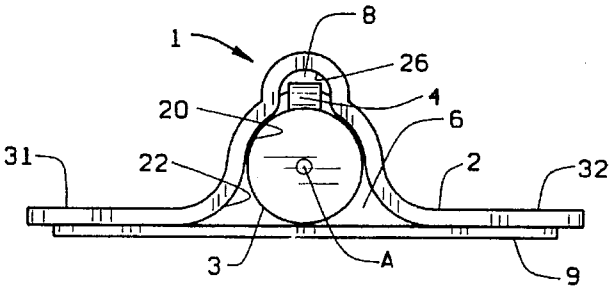
FIG. 6 is a rear plan view of the garment bag hanger assembly.
Figure 5:
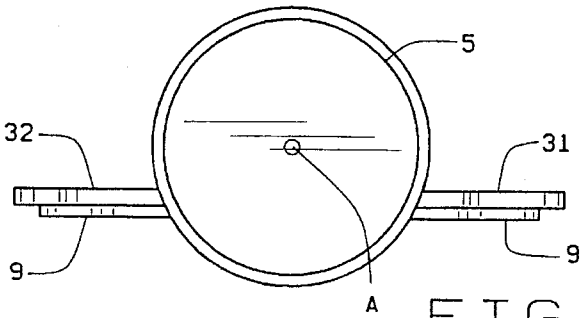
FIG. 5 is a front plan view of the garment bag hanger assembly.

The rod channel 6 of the mounting sleeve 2 is constructed to receive rod 3, i.e., the rod channel 6 has a sufficient diameter to receive the rod 3 when mounting the mounting sleeve 2 on the plate 9. The knob 5 extends outwardly out of the open mouth 24 of the rod channel 6 such that the rod 3 may be selectively extended from and retracted into the rod channel 6 through the open mouth 24. Meanwhile, the guide channel 8 slidably receives the boss 4 of the rod 3 for preventing rotation of the rod 3 relative to the rod channel 6. As shown in FIG. 6, the boss 4 is engageable with the sides of the guide channel 8 for holding the rod 3 from rotating about its longitudinal axis A.

A crimp 17, defining a stop, is formed in the guide channel 8 generally adjacent to the right-hand side of the guide channel 8 as shown in FIGS. 1–4 and 7–8. The crimp 17 projects inwardly into the guide channel 8 and is designed to occupy substantially the entire cross-sectional space of the guide channel 8 (see FIG. 7). The crimp 17 engages the boss 4 when the rod is moved from its retracted position (as shown in FIG. 7) to its fully extended position (as shown in FIG. 8) in order to prevent the complete withdrawal of the rod 3 from the mounting sleeve 2 through the mouth 24 of the rod channel 6. In those instances where the boss is moved along the length of the rod 3, the crimp 17 is not generally moved so that the knob 5 can extent outwardly selected distances, as may be desired by a customer.

Two flanges 31 and 32 (broadly "flange means") extend laterally outwardly from the longitudinal edges of the slot 22 of the rod channel 6 for engaging the top surface of the plate 9 (see generally FIGS. 1–6). The flanges 31 and 32 preferably extend continuously along the longitudinal edges of the slot 22 of the rod channel 6 preferably the entire length of the rod channel 6. The flanges 31 and 32 are constructed for face to face engagement with the top surface of the plate 9. Each flange 31 and 32 includes a pair of clearance openings 12 spaced from one another a distance corresponding to the distance of a pair of longitudinal spaced holes 10 provided in plate 9. The openings 12 are adapted to be aligned with the holes 10 of the plate 9 and receive fasteners 11 therethrough for mounting the mounting sleeve 2 in proximity to the top side of the plate 9 with the rod 3 being disposed in the rod channel 6 and the boss 4 being disposed in the guide channel 8.

In manufacturing the hanger assembly 1, the flanges 31 and 32 and mounting sleeve 2 are preferably made from a sheet metal blank and formed in one piece. The rod channel 6 and the guide channel 8 are formed by bending the sheet metal blank in a conventional manner well known in the art. The crimp 17 may be formed in the guide channel 8 by any appropriate means such as by using a stamping tool which is also well known in the art.

All of the elements of the hanger assembly 1 may be provided as a kit for installation on site in a closet or in a room. The hanger assembly 1 is installed by inserting a hanger rod into a rod channel 6 of a mounting sleeve 2. The rod is positioned in the rod channel such that a boss 4 of the rod 3 is received in a guide channel 8 of the mounting sleeve 2. The boss and the guide channel prevent the rotation of the rod 3 relative to the mounting sleeve 2. The mounting sleeve 2, with the rod 3 inserted therein, is positioned against the top surface of a plate 9 such that the openings 12 in the mounting flanges 31 and 32 are aligned with the holes 10 of the plate 9. The bottom side of the plate 9 is then positioned adjacent either a projecting corner of a wall W, a solid shelf (not shown), or a ventilated shelf V. If the hanger assembly 1 is mounted to a wall W or a solid shelf (not shown), screw fasteners are threaded through the aligned openings 12 and holes 10 and then into the wall W or solid shelf (now shown) for securing the hanger assembly 1 to the wall W or solid shelf.

As shown in FIGS. 2, if the hanger assembly 1 is mounted to a ventilated shelf V which has a plurality of openings formed therethrough, a U-shaped fastener 13 is used to secure the hanger assembly 1 to the ventilated shelf V. The U-shaped fastener 13 has a base with two legs extending outwardly in the same direction from each end of the base. To mount the hanger assembly on the ventilated shelf V, each U-shaped fastener 13 is inserted from the opposite side on which the hanger assembly 1 is disposed such that the legs of the U-shaped fastener 13 extend through openings in the ventilated shelf V, next through a set of openings 10 in the plate 9 and then through a pair of corresponding holes 12 in flanges 31 and 32 (see FIG. 3). The base of the fastener 13 may be positioned on the opposite side of the ventilated shelf V than the hanger assembly 1, if desired. The U-shaped fastener 13 is held in place by securing capped nuts 15 to the ends of each leg of the U-shaped fastener 13. Of course, other types of fasteners such as a nut and bolt, fastener strap or other suitable device may be used.

The foregoing description is set forth only for illustrative purposes only and is not meant to be limiting. Numerous variations, within the scope of the appended claims will be apparent to those skilled in the art in light of the foregoing description and accompanying drawings.

What is claimed is:

1. An extensible and retractable hanger assembly adapted to be mounted on a shelf or wall for hanging articles such as a garment bag therefrom, the hanger assembly comprising:

a hanger rod having a longitudinal axis and being formed at one end for retaining articles hung on the rod from falling off the rod, the hanger rod also having a boss projecting outwardly from the rod;

a mounting sleeve including a rod channel and a guide channel formed in the bottom of the rod channel;

the rod channel including a bottom and an open slot opposite the bottom which extends the length of the channel and which terminates in an open mouth generally at one longitudinal end of the rod channel, the open slot having sufficient width to admit the hanger rod through the open slot and into the rod channel with said formed end of the rod extending outwardly from the open mouth of the rod channel such that the rod may be selectively extended from and retracted into the rod channel through the open mouth thereof;

the guide channel opening up into the bottom of the rod channel and closed at its bottom opposite the opening into the rod channel, the guide channel being smaller than the rod channel and adapted to slidably receive the boss of the hanger rod, the guide channel having a stop for engagement with the boss to prevent withdrawal of the hanger rod from the mounting sleeve through the open mouth thereof, the boss being engageable with sides of the guide channel for holding the hanger rod from rotation about its longitudinal axis in the rod channel;

the stop comprising a crimp in the bottom of the guide channel which projects inwardly into the guide channel for engaging the boss, the size and construction of the boss, crimp and guide channel causing the hanger rod to be held from further movement longitudinally out of the mouth of the rod channel upon engagement of the boss with the crimp;

a plate having a plurality of holes adapted to receive a plurality of fasteners therethrough; and flange means extending laterally outwardly from longitudinal edges of the open slot in the rod channel for engaging the plate, said flange means being adapted to receive the fasteners that extend through the plate for mounting the plate in proximity to the flange means whereby the plate closes the open slot of the mounting sleeve for holding the hanger rod from movement laterally out of the rod channel in order that the hanger assembly can be mounted on the wall or shelf for reliable operation.

2. The hanger assembly of claim 1 wherein the mounting sleeve and flange means are formed as one piece with a sheet metal construction.

3. The hanger assembly of claim 1 wherein said flange means comprises flanges extending continuously along the longitudinal edges of the slot of the rod channel substantially the entire length of the rod channel, the flanges being constructed for face to face engagement with the plate, and having a plurality of openings of predetermined spacing adapted to be aligned with the holes preformed in the plate for use in mounting the hanger assembly to a shelf or wall.

4. The hanger assembly of claim 1 wherein said formed end of the hanger rod comprises a universally adaptive easy-to-grip knob attached to said end of the rod.

5. The hanger assembly of claim 4 wherein said hanger assembly is mounted to said wall by inserting the fasteners into the wall.

6. The hanger assembly of claim 5 wherein said hanger assembly is mounted to a ventilated shelf having a plurality of openings formed therethrough for receiving two legs of a U-shaped fastener, said U-shaped fastener also extending into a set of holes in said plate and a corresponding pair of openings in the flanges, the U-shaped fastener being secured in place by capped nuts fastened to a free end of each leg.

7. An extensible and retractable hanger assembly for hanging articles such as garment bags, the hanger assembly comprising:

a plate having a top side and a bottom side and further having at least two sets of holes therein, adjacent holes in each set having the same predetermined lateral spacing from each other, the sets being longitudinally spaced at a predetermined distance;

a plurality of fasteners adapted to be received in the holes in the plate;

a hanger rod having a longitudinal axis with a knob at one end thereof and a boss projecting outwardly from the rod at a location longitudinally spaced from the knob;

a mounting sleeve having a rod channel including a bottom and an open slot opposite the bottom which extends the length of the rod channel and which terminates in an open mouth generally at one longitudinal end of the rod channel, a guide channel being formed in the bottom of the rod channel, the guide channel being smaller than the rod channel, the guide channel opening into the bottom of the rod channel and being closed at its bottom opposite the opening into the rod channel;

the rod channel being adapted to slidably receive the hanger rod with the knob disposed outwardly from the open mouth of the rod channel such that the rod may be selectively extended from and retracted into the rod channel through the open mouth thereof, the guide channel being adapted to slidably receive the boss and having a stop engageable with the boss to prevent withdrawal of the hanger rod from the mounting sleeve through the open mouth of the rod channel, the boss being adapted to engage sides of the guide channel for holding the hanger rod from rotation about its longitudinal axis in the rod channel, the stop comprising a crimp in the bottom of the guide channel which projects inwardly into the guide channel for engaging the boss, the size construction and arrangement of the boss, crimp and guide channel being such that the hanger rod is held from further movement longitudinally out of the mouth of the rod channel upon engagement of the boss with the crimp;

flanges extending generally along longitudinal edges of the slot of the rod channel, the flanges being constructed for face to face engagement with the top side of the plate, each flange having at least two openings with longitudinal spacing equal to the longitudinal spacing between the sets of holes in the plate, corresponding openings of the flanges also being generally laterally aligned and having a lateral spacing equal to the lateral spacing between adjacent holes in the plate whereby the openings in the flanges are adapted to be aligned with holes in the plate in order to receive said fasteners therethrough for proximate positioning of the mounting sleeve on the top side of the plate; and the bottom side of the plate being mounted to a wall or to a shelf by further inserting said fasteners into the wall or the shelf.

8. The hanger assembly of claim 7 wherein said hanger assembly is mounted to a ventilated shelf having a plurality of openings extending therethrough for receiving two legs of a U-shaped fastener, said U-shaped fastener also extending into a set of holes in said plate and a corresponding pair of openings in the flanges, the U-shaped fastener being secured in place by capped nuts fastened to a free end of each leg.

9. The hanger assembly of claim 8 wherein the mounting sleeve and flanges are made in one piece from a sheet metal blank.

10. An extensible and retractable hanger assembly adapted to be mounted on a shelf or wall for hanging articles such as a garment bag therefrom, the hanger assembly comprising:

a hanger rod having a longitudinal axis and being formed at one end for retaining articles hung on the rod from falling off the rod, the hanger rod also having a boss projecting outwardly from the rod;

a mounting sleeve including a rod channel and a guide channel formed in the bottom of the rod channel;

the rod channel including a bottom and an open slot opposite the bottom which extends the length of the channel and which terminates in an open mouth generally at one longitudinal end of the rod channel, the open slot having sufficient width to admit the hanger rod through the open slot and into the rod channel with said formed end of the rod extending outwardly from the open mouth of the rod channel such that the rod may be selectively extended from and retracted into the rod channel through the open mouth thereof;

the guide channel opening up into the bottom of the rod channel and closed at its bottom opposite the opening into the rod channel, the guide channel being smaller than the rod channel and adapted to slidably receive the boss of the hanger rod;

the guide channel having a stop for engagement with the boss to prevent withdrawal of the hanger rod from the mounting sleeve through the open mouth thereof, the boss being engageable with sides of the guide channel for holding the hanger rod from rotation about its longitudinal axis in the rod channel, the stop extending from the bottom of the guide channel and inwardly into the guide channel for engaging the boss, the size and construction of the boss, stop and guide channel causing the hanger rod to be held from further movement longitudinally out of the mouth of the rod channel upon engagement of the boss with the stop, the guide channel being smaller than the rod channel and adapted to slidably receive the boss, the guide channel having a stop for engagement with the boss to prevent withdrawal of the hanger rod from the mounting sleeve through the open mouth thereof, the boss being engageable with sides of the guide channel for holding the hanger rod from rotation about its longitudinal axis in the rod channel;

a plate having a plurality of holes adapted to receive a plurality of fasteners therethrough; and flange means extending laterally outwardly from longitudinal edges of the open slot in the rod channel for engaging the plate, said flange means being adapted to receive the fasteners that extend through the plate for mounting the plate in proximity to the flange means whereby the plate closes the open slot of the mounting sleeve for holding the hanger rod from movement laterally out of the rod channel in order that the hanger assembly can be mounted on the wall or shelf for reliable operation.

* * * * *